US008205676B2

(12) United States Patent
Nelson et al.

(10) Patent No.: US 8,205,676 B2
(45) Date of Patent: Jun. 26, 2012

(54) WATER WELL CLEANING APPARATUS AND METHOD

(76) Inventors: Dan Nelson, Dimmitt, TX (US); Robert Nelson, Dimmitt, TX (US)

( * ) Notice: Subject to any disclaimer, the term of this patent is extended or adjusted under 35 U.S.C. 154(b) by 187 days.

(21) Appl. No.: 12/841,524

(22) Filed: Jul. 22, 2010

(65) Prior Publication Data

US 2012/0018163 A1 Jan. 26, 2012

(51) Int. Cl.
*E21B 37/00* (2006.01)

(52) U.S. Cl. ..... 166/312; 166/223

(58) Field of Classification Search ..... 166/312, 166/311, 222, 223; 134/166 C
See application file for complete search history.

(56) References Cited

U.S. PATENT DOCUMENTS

| | | | | | |
|---|---|---|---|---|---|
| 2,302,567 | A * | 11/1942 | O'Neill | 166/278 |
| 2,887,118 | A * | 5/1959 | Loeffler et al. | 134/112 |
| 3,547,191 | A * | 12/1970 | Malott | 166/223 |
| 3,720,264 | A * | 3/1973 | Hutchison | 166/311 |
| 3,994,310 | A * | 11/1976 | Brandon | 134/167 C |
| 4,037,661 | A * | 7/1977 | Ford | 166/311 |
| 4,073,302 | A * | 2/1978 | Jones | 134/167 C |
| 4,164,325 | A * | 8/1979 | Watson | 239/252 |
| 4,518,041 | A * | 5/1985 | Zublin | 166/312 |
| 4,688,637 | A * | 8/1987 | Theis | 166/245 |
| 4,765,410 | A * | 8/1988 | Rogers et al. | 166/303 |
| 5,038,810 | A * | 8/1991 | Pacheco et al. | 134/167 R |
| 5,725,680 | A | 3/1998 | Mathieus | |
| 5,848,877 | A | 12/1998 | Dill et al. | |
| 5,941,258 | A * | 8/1999 | Flenniken et al. | 134/22.12 |
| 6,062,311 | A * | 5/2000 | Johnson et al. | 166/312 |
| 6,390,105 | B1 * | 5/2002 | Ramsey | 134/167 C |
| 6,533,035 | B2 * | 3/2003 | Troutt et al. | 166/249 |
| 6,613,154 | B1 * | 9/2003 | Lester | 134/8 |
| 7,017,593 | B2 * | 3/2006 | Honda | 134/22.11 |
| 7,987,906 | B1 * | 8/2011 | Troy | 166/222 |
| 2004/0016540 | A1 * | 1/2004 | Jarchau et al. | 166/222 |
| 2005/0061503 | A1 * | 3/2005 | Misselbrook et al. | 166/278 |
| 2009/0308595 | A1 * | 12/2009 | Hatten | 166/223 |
| 2010/0258299 | A1 * | 10/2010 | Hatten | 166/223 |

OTHER PUBLICATIONS

Jill Ross, "The Modern Contractor's Well Rehab Toolbox," Water Well Journal, Apr. 2009; 4 pages.

* cited by examiner

*Primary Examiner* — Daniel P Stephenson
(74) *Attorney, Agent, or Firm* — Charles D. Gunter, Jr.

(57) ABSTRACT

A method and system for cleaning the perforations of well casings employs a non-rotating tubing string attached to a hydraulic jet carrier body. The carrier body has outwardly extending arms which terminate in spray nozzles, each of the nozzles expelling a stream of fluid under pressure against the well casing with an inertial force. The nozzles are oriented on the carrier body such that the reactive force for each jet is directionally offset with respect to the central axis of the carrier, thereby creating a twisting moment tending to rotate the carrier body about its central axis. The nozzles are located a fixed distance from the carrier body which is between about ½ and 1½ inches from the well casing perforations in use.

10 Claims, 3 Drawing Sheets

WATER WELL CLEANING APPARATUS AND METHOD

BACKGROUND OF THE INVENTION

1. Field of the Invention

The present invention relates to the field of water well refurbishing, and more specifically to cleaning devices and techniques for use in cleaning the slots, perforations or other openings present in water well casings or screens.

2. Description of the Prior Art

In most rural environments, water wells are a given necessity. Water wells and their associated down hole pumps are the modern day equivalent of windmills, which were historically used to move water from one location or one depth to another. In addition to providing water for such everyday activities as showering, doing laundry and running the dishwasher, water wells are also used at the present time for such diverse purposes as irrigating crops, providing livestock with water, supplying water to remote locations, or for acting as heating and cooling mechanisms for geothermal systems. The completed water well may utilize any of several commercially available pumps to bring the water to the well surface. For example, three of the commonly used well pumps at the present time are the electric submersible pump, the reciprocating plunger well pump, and the line-shaft turbine pump.

In the present day water well producing arts, it is customary to complete the well by inserting a metallic well liner, sometimes referred to as a "casing", adjacent the water-producing formation. Water wells throughout the Ogallala aquifer and many other aquifers are cased with steel pipe, typically pipe which is from twelve to sixteen inches in diameter. This pipe is normally perforated by torch cutting or is provided with manufactured slots. Another frequently encountered water well installation uses a screen type pipe, commonly known as "ag screen" or "Johnson well screen." The purpose of the slots, perforations or screens is to allow the water from the surrounding water bearing formation to infiltrate the casing, while holding back sand or other particulates, so that the downhole pump in the well can transport the water from the water bearing strata to the surface for distribution in irrigation, industrial or consumptive use.

The openings in the well casing thus provide passage-ways for the flow of water and other formation fluids from the formation into the well for removal to the surface. However, over time, the openings will often become plugged with foreign material, such as sand, the products of corrosion, sediment deposits and other inorganic or organic complexes. Over time, these various foreign materials begin to cake up and clog the holes or perforations in the casing or screen. Also, over time, depending upon conditions, lime contained in the water will accumulate around the screen and will also plug up the openings. As the sand, limestone and other materials build or cake up, they close off portions of the perforated casing or screen. This naturally reduces pumping efficiency, reduces intake of water, increases the pumping head, and increases the pumping cost.

Obviously, the smaller the perforations or screen, the more likely the plugging will be and the more quickly the plugging will take place. Mill slot casing and ag screen casing have the smallest openings and are the most likely to plug. Similarly, the smaller torch cut perforations are highly likely to plug, as well. Torch cut perforations range from about ⅛ inch to about ½ inch, depending on the formation in which the well may be drilled. Smaller perforations are typically used to limit sand inflow to the pump.

Since removal and replacement of the well casing is costly, various methods have been developed to clean plugged openings though various remedial operations, including chemical treatments, mechanical techniques (e.g., brushing and bailing), the use of a high pressure air gun to create a hydraulic wave, the use of jetted streams of liquid, re-perforating the casing, etc. In fact, it is often necessary to perform some type of cleaning operation every 2 or 3 years in large municipal or industrial water wells.

The use of fluid jet techniques was first introduced in about 1938 to directionally deliver acid to dissolve carbonate deposits. In about 1958 the development of tungsten carbide jets permitted including abrasive material in a liquid which improved the ability of a fluid jet to do useful work. However, the inclusion of abrasive material in a jet stream was found to be an ineffective perforation cleaning method in that it enlarged the perforation which hampered or destroyed the perforation sand screening capabilities. Other liner and casing cleaning technologies have been described in the prior art in relation to cleaning the liners or casings of oil and gas hydrocarbon producing wells. While there are some similarities to the cleaning of water wells, the oil and gas well rehabilitation equipment tends to be more complicated and expensive with the tools often being run on metal tubing or drill string or off reels of metallic coiled tubing and the like.

With respect to the other prior art processes which have been employed for water wells, none have proved to be entirely satisfactory. Often the surface of the well casing is cleaned relatively well, but the perforations are almost never cleaned out entirely satisfactorily.

A need exists, therefore, for an improved water well cleaning apparatus and method which meets the above noted needs and overcomes the difficulties of the prior art.

SUMMARY OF THE INVENTION

The present invention is a system for cleaning the water well casing of a water well of the traditional type having a well bore and a metal casing installed within the well bore. The casing would have internal sidewalls of a given internal diameter and have at least a length thereof which is perforated to allow the flow of water from a surrounding subterranean formation. This is the traditional water well completion arrangement which has been used in many environments over a number of years.

The system of the invention includes a non-rotating tubing string formed from a synthetic polymeric material and having a surface end and a distal end. A bearing assembly is attached to the distal end of the tubing string and is adapted to be lowered to a predetermined depth within the well bore. The bearing assembly has a generally tubular body with an internal flow path which provides a path for a cleaning fluid and has a central axis. A jet nozzle carrier is rotatably mounted on the bearing assembly along the bearing central axis for rotation about the central axis. The jet nozzle carrier has a carrier body with at least one pair of outwardly extending tubular arms which extend from the carrier body generally perpendicular to the central axis of the bearing assembly and of the carrier body. Each of the outwardly extending arms terminates in a spray nozzle.

A source of pressurized cleaning fluid is provided which communicates with the jet nozzle carrier for supplying fluid under pressure to the spray nozzles. Each of the spray nozzles is adapted to expel the cleaning fluid against the casing internal sidewalls with an inertial force. The inertial force has an equal and opposite reactive force. The pair of nozzles are mounted in the carrier body such that the reactive force is directionally offset from said carrier axis, thereby creating a twisting moment about the axis tending to rotate the jet nozzle carrier about the carrier central axis. In a preferred version of the system of the invention, the length of the outwardly extending tubular arms on the carrier body are each set at a predetermined distance from the carrier body. In the preferred embodiment, the spray nozzles located on the arms are positioned from within about ½ inch to 1½ inches from the perforations in the casing internal sidewalls in use. A take up reel, located at the well surface, is provided for vertically moving the tubing string and carrier within the well bore. In a particularly preferred version of the system of the invention, the spray nozzles are located approximately 1 inch from the perforations in the casing internal sidewalls in use.

There may be additional nozzles located on the carrier body which are not on outwardly extending tubular arms and which are also supplied with pressurized fluid for spraying the surrounding casing internal sidewalls. The source of pressurized cleaning fluid is preferably a piston pump mounted on a flat bed truck and powered by a diesel engine, the pump being capable of producing at least about 25 gpm at 4000 psi.

The jet nozzle carrier body may also be centered in the well bore by means of a roller cage mounted on the tubing string above jet nozzle carrier body. The preferred roller cage has at least three longitudinal traveling arms alignable along the well bore axis, each of which has a roller mounted on either of two opposing outer extents thereof. Each of the traveling arms is connected to the tubing string by a scissor mechanism which allows radial inward and outward movement of the jet nozzle carrier body and its associated bearing assembly in order to continuously center the jet nozzle carrier body within the well bore.

In a particularly preferred method of using the above described system, a non-rotating tubing string is provided with a source of fluid pressure for expelling a stream of fluid against the internal sidewalls of a well casing, the pressure source being arranged to communicate with the tubing string. Fluid is supplied under pressure through the tubing string to a jet carrier body having a plurality of spray nozzles arranged thereon so that the fluid pressure creates a twisting moment tending to angularly displace the spray nozzles about a central axis of the carrier body. The carrier body is moved vertically along the internal sidewalls of the well casing while spraying cleaning fluid through the nozzles. At least selected nozzles are mounted on the jet carrier body by outwardly extending tubular arms which extend from the carrier body generally perpendicular to the central axis thereof, each arm terminating in a spray nozzle. The length of each of the outwardly extending tubular arms on the carrier body is set at a predetermined distance, so that the spray nozzles located on the arms are positioned from within about ½ inch to 1½ inches from the perforations in the casing internal sidewalls in use, most preferably about 1 inch from the perforations in the casing internal sidewalls.

The well being treated is a traditional water well having a water bearing formation located at a known depth in the well bore. One cleaning method used is to move the cleaning apparatus slowly up 10 feet and then back down to the well bottom, followed by moving the apparatus up 20 feet and then back to the well bottom, followed by moving the apparatus up 30 feet and then back to the well bottom, and repeating the procedure until a depth is reached about 10 feet above the depth of the water bearing formation. Another technique which can be used is to move the cleaning apparatus only inches at a time, leaving the apparatus at a given depth for 20-30 seconds at a flow rate of 25 gpm at 4000 psi.

Additional objects, features and advantages will be apparent in the written description which follows.

DETAILED DESCRIPTION OF THE INVENTION

The embodiments herein and the various features and advantageous details thereof are explained more fully with reference to the non-limiting embodiments that are illustrated in the accompanying drawings and detailed in the following description. Descriptions of well-known components and processes and manufacturing techniques are omitted so as to not unnecessarily obscure the embodiments herein. The examples used herein are intended merely to facilitate an understanding of ways in which the invention herein may be practiced and to further enable those of skill in the art to practice the embodiments herein. Accordingly, the examples should not be construed as limiting the scope of the claimed invention.

Figure 1:
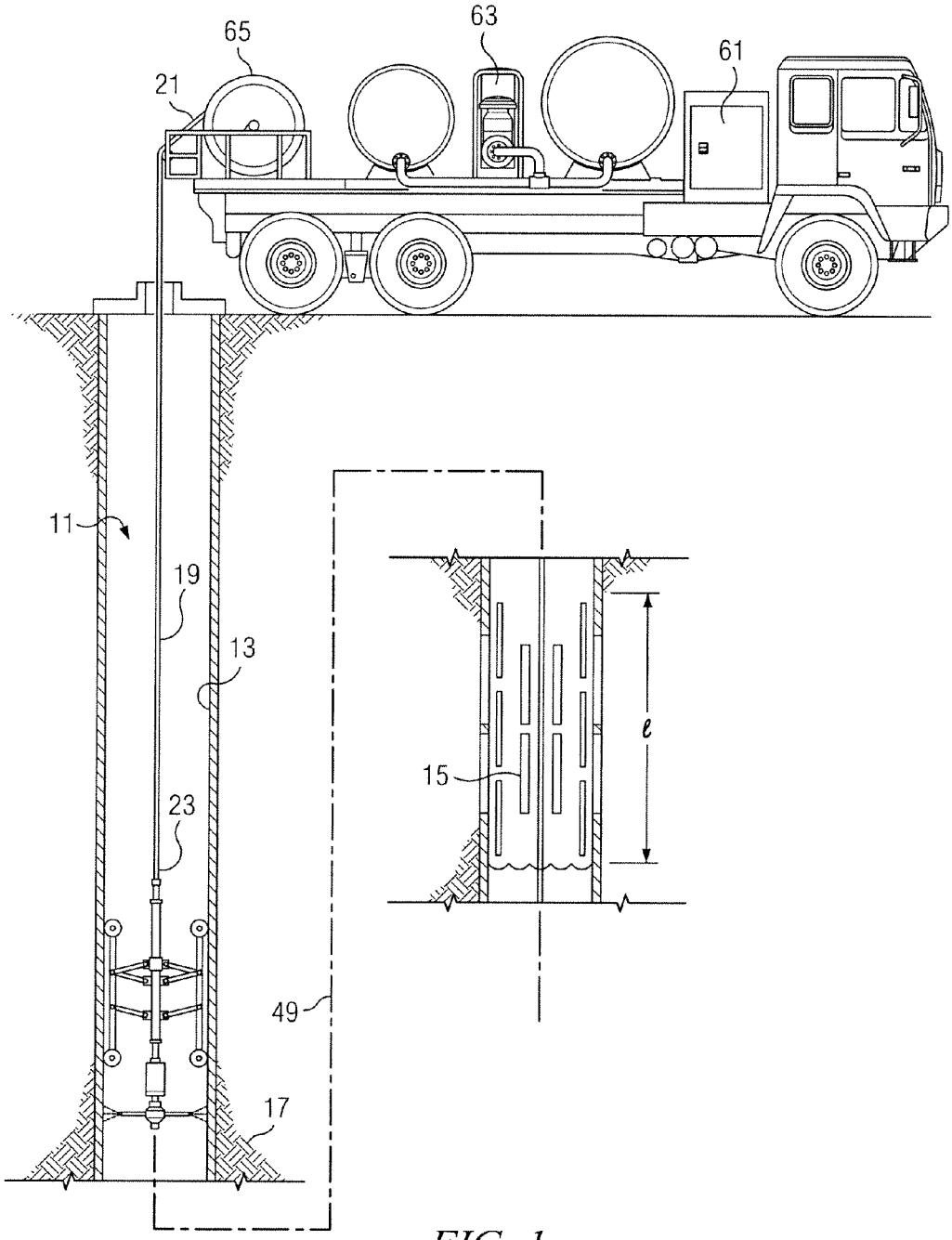
FIG. 1 is a simplified, partly schematic view of the well cleaning system of the invention in use and showing the apparatus of the invention being lowered into a well bore to a water bearing subterranean formation by means of a truck mounted take up reel.

Turning now to FIG. 1, there is shown a system of the invention used to clean a cased well bore 11. The well bore is that of a typical water well drilled to a typical depth of for example, 300-500 feet. The well bore is "cased" with a metal liner 13 having internal sidewalls of a given internal diameter and having at least a length thereof (as at "1" in FIG. 1) which is perforated by openings 15 to allow the flow of water from a surrounding subterranean formation 17. By "perforated" is meant that the metal casing has openings, slots milled or torch cut, or is made of "ag screen", as described in the Background portion of the Specification. The term "perforated" will be intended to encompass all of the currently available openings, perforations or slots, for ease of description in the discussion which follows.

As mentioned in the Background discussion, the size of the perforations will generally dictate how quickly the casing will require remedial work, the smaller the perforations or screen openings, the more likely the plugging will be and the more quickly the plugging will take place. Thus, mill slot casing and ag screen casing which have the smallest openings, on the order of 0.006 to 0.008 inches, and are the most likely to plug. Similarly, the smaller torch cut perforations are highly likely to plug, as well. Torch cut perforations generally range from about ⅛ inch to about ½ inch, depending on the formation in which the well may be drilled. The preferred perforation size range for torch cut perforations is in the range from about ½ inch to ⅜ inches for purposes of the present invention.

The system of the invention preferably uses a non-rotating tubing string 19 formed from a synthetic polymeric material and having a surface end 21 and a distal end 23. By synthetic polymeric material is meant, for example, a commercially available nylon reinforced plastic tubing which has been found suitable for operating pressures on the order or 4000 psi. For greater operating pressures, e.g., on the order of 10,000 psi, a steel braided, reinforced synthetic flexible tubing is preferred. These synthetic polymeric materials are to be contrasted with typical oil and gas well cleaning units which are often run on metal coil tubing strings, or on metal drill pipe or tubing.

Figure 2:
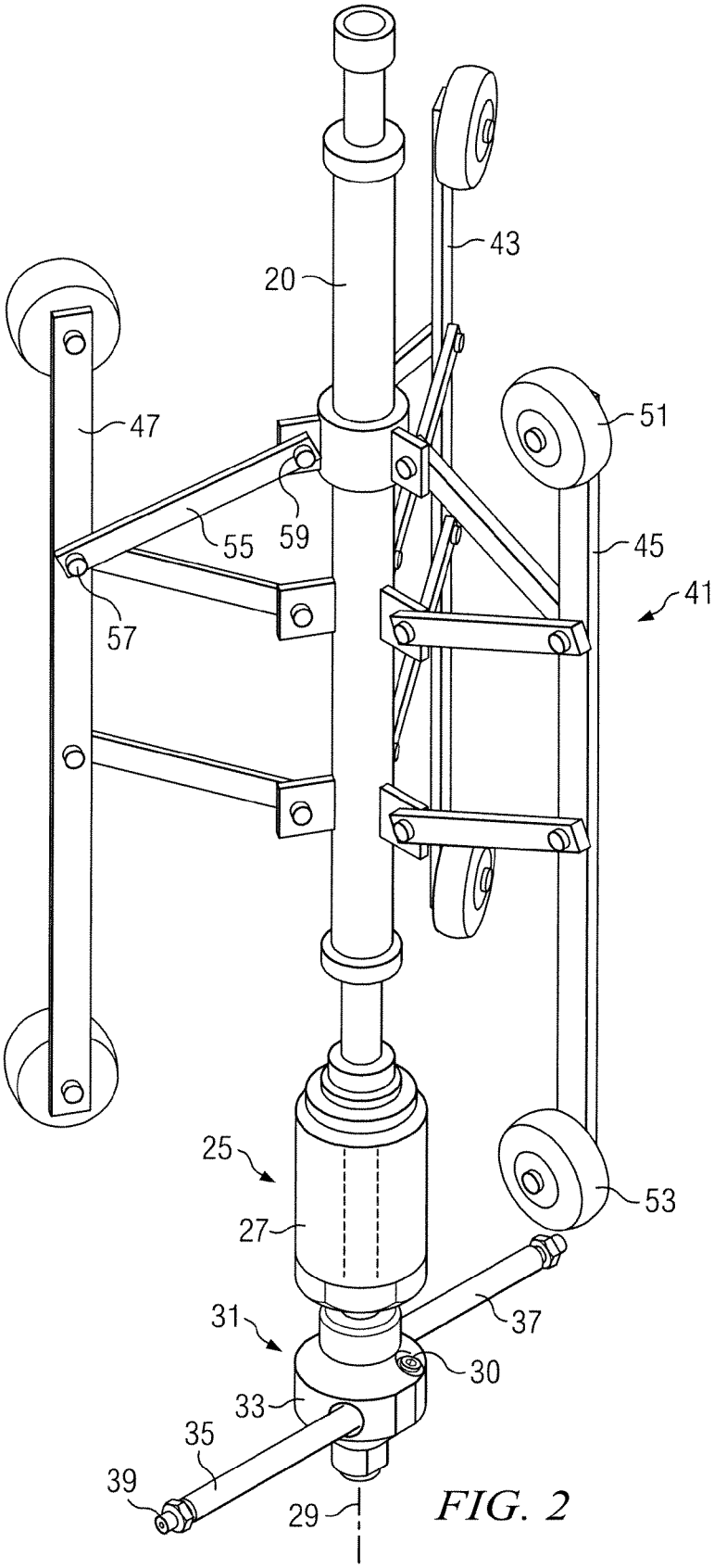
FIG. 2 is a perspective view of the apparatus used in the system of the invention and showing the roller cage which is used to center the apparatus in the well bore during use.
Figure 3:
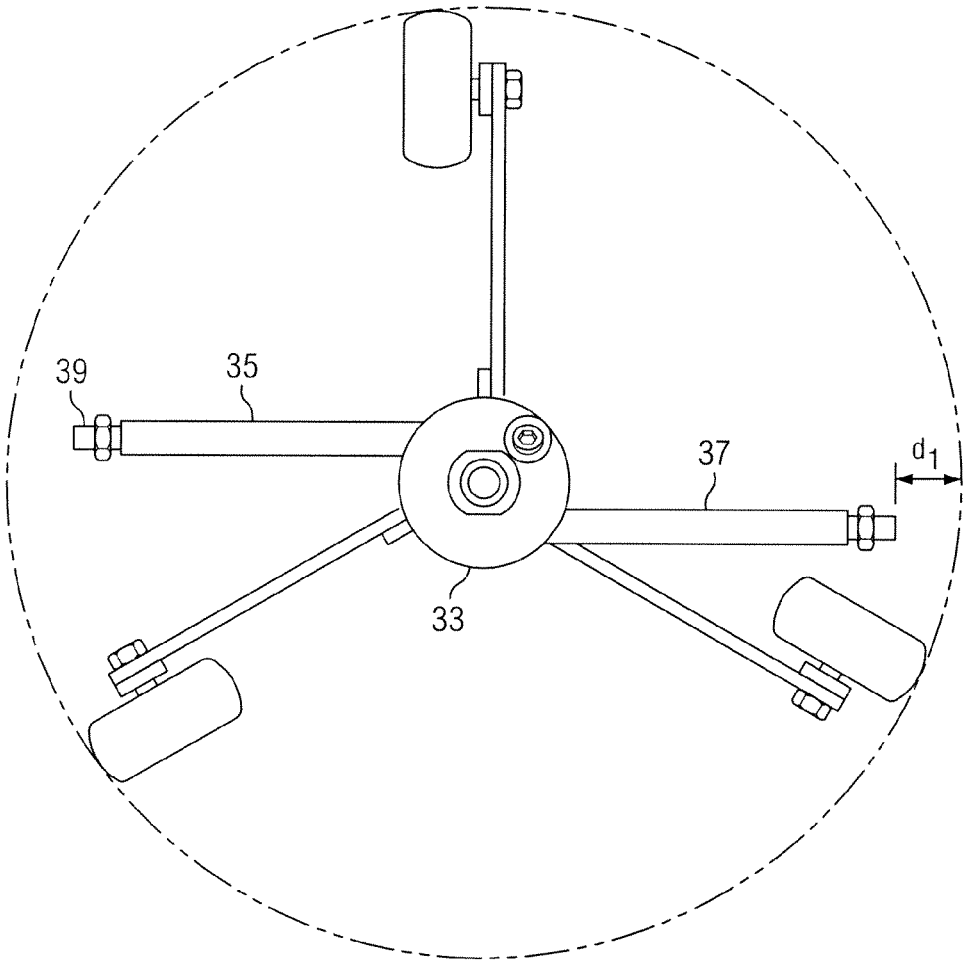
FIG. 3 is a bottom view of the apparatus of the invention showing the relative distance between the nozzles and the perforations in the sidewall of the well casing being treated.

As seen in FIGS. 2 and 3, a bearing assembly 25 is attached to the distal end 23 of the tubing string by means of a rigid extension section 20 and is adapted to be lowered to a predetermined depth within the well bore in order to accomplish the cleaning operation. The bearing assembly 25, as perhaps best seen in FIG. 2, has a generally tubular body 27 with an internal flow path (shown as dotted lines in FIG. 2) which provides a path for a cleaning fluid and has a central axis 29. The typical cleaning fluid will be water, which may be chemical free. However, it is possible that, depending on the particular well situation at hand, that chemical additives such as bactericides, acids, or other additives conventional in the industry, might be utilized in the cleaning solution, depending upon the condition of the particular well bore being treated.

As can be seen in FIGS. 2 and 3, a jet nozzle carrier 31 is rotatably mounted on the bearing assembly 25 along the bearing central axis 29 for rotation about the central axis. The jet carrier has a carrier body 33 with at least a pair of outwardly extending tubular arms 35, 37, which extend from the carrier body 33 generally perpendicular to the central axis 29 of the bearing assembly and of the carrier body. Each of the outwardly extending arms 35, 37, terminates in a spray nozzle, such as nozzle 39 in FIG. 2. The length of the outwardly extending tubular arms 35, 37, on the carrier body is a fixed, predetermined distance, so that the spray nozzles located on the arms are positioned from within about ½ inch to 1½ inches, most preferably about 1 inch, from the perforations in the casing internal sidewalls in use. The preferred distance is illustrated as "$d_1$" in FIG. 3 of the drawings.

The number and size of the nozzles present on the jet nozzle carrier body 31 may vary depending upon the well application at hand. By way of example, in one preferred version of the apparatus of the invention, there are six fixed outlets on the carrier body, each having a ¼ inch type F NPT opening. A nipple is mounted in each outlet which is ¼ inch M NPT by ⅛ inch F NPT, so that the resulting assembled nozzles are ⅛ inch F NPT with an orifice size of 0.072 inch diameter and with a 25 degree spray. In the preferred arrangement, only the nozzles which are located in a horizontal plane with respect to the axis 29 are utilized. However, it should be understood that there may be, for example, additional nozzles located on the carrier body which are not on outwardly extending tubular arms and which are also supplied with pressurized fluid for spraying the surrounding casing internal sidewalls. See, for example, the nozzle location 30 in FIG. 2. On some occasions, a straight spraying nozzle with a 0.063 inch diameter orifice has been utilized.

The preferred apparatus used in the system of the invention also includes a roller cage (illustrated generally at 41 in FIG. 2) mounted on the rigid extension 20 of the tubing string 19 above the bearing assembly 25 and jet nozzle carrier body 31 for centralizing the bearing assembly and carrier body in the well bore during use. The preferred roller cage 41 shown in FIG. 2 has at least three longitudinal traveling arms 43, 45, 47, alignable along the well bore axis (generally at 49 in FIG. 1). Each of the traveling arms 43, 45, 47, has a roller (such as rollers 51, 53 in FIG. 2) mounted on either of two opposing outer extents thereof. Each of the traveling arms is connected to the tubing string by a scissor mechanism which allows radial inward and outward movement of the tubing string as the rollers travel longitudinally along the well casing internal sidewalls. For example, as can be seen in FIG. 2, the traveling arm 47 has intermediate pivot arms, such as arm 55, with opposing pivot points 57, 59, which allow inward and outward movement of the traveling arm 47 with respect to the rigid extension of the tubing string.

A source of pressurized cleaning fluid communicates with the jet nozzle carrier 25 for supplying fluid under pressure to the nozzles. Each of the nozzles, such as nozzle 39 in FIG. 2, is in turn adapted to expel the cleaning fluid against the casing internal sidewalls. Because of the arrangement of the outwardly extending arms 35, 37 on the jet nozzle carrier body 31, the spray creates an inertial force. This inertial force has an equal and opposite reactive force, at least one of the nozzles being mounted in the carrier body such that said reactive force is directionally offset from said carrier axis 29. As a result, there is created a twisting moment about the axis 29 tending to rotate the carrier body 33 about the carrier central axis in use. The end result is that the nozzle 39 is spinning about the axis 29 and is located in close proximity (preferably within about 1 inch distance) to the internal diameter of the well casing being cleaned.

Systems for supplying high pressure cleaning fluids to blasting guns and heads are well known. For example, high pressure fluid systems are commonly used to supply water or another liquid to the high pressure gun for conducting blasting operations, for concrete demolition, for surface cleaning and paint removal, for precision cutting, and for food processing applications. Conventional systems include a diesel engine which outputs power to a mechanical transmission assembly and then to a positive displacement pump of the type disclosed in U.S. Pat. Nos. 4,551,077 and 4,716,924. A plunger-type pump with an improved technique for loading compression rods is disclosed in U.S. Pat. No. 5,302,087. U.S. Pat. No. 5,385,452 discloses the desired portability of equipment for water blasting and cutting operation.

In a conventional water blasting system, power may be generated by a diesel engine (such as engine 61 in FIG. 1) which transmits mechanical energy through a mechanical transmission and a flexible coupling (not shown) to a positive displacement pump 63. Piston or plunger-type pumps are typically desired over other types of pumps when used under conditions for generating fluid pressure in excess of 1,000 psi. In a conventional application, the operator may manipulate a standard clutch, an engine throttle, and a mechanical gear shift assembly to operate the engine and transmission, thereby supplying the required rpm and torque output to the pump for generating and maintaining the desired high pressure from the pump. In the system of the invention, the piston pump 63 is typically mounted on a flat bed truck (as shown in FIG. 1) and powered by the truck's diesel engine. The pump 63 may be capable of producing, for example, on the order of 1,000 to 40,000 psi and preferably ranges from about 1,000 to 10,000, and is capable of producing, for example, at least about 25 gpm at 4000 psi. Fluid output by the pump passes through the flexible hose 19 to the jet nozzle carrier body 25.

The flat bed truck also typically houses a take up reel (65 in FIG. 1) for vertically moving the tubing string and jet nozzle carrier up and down within the well bore. The take up reel 65 is of conventional design and will be familiar to those skilled in the well cleaning arts.

In use, pressurized cleaning fluid is supplied to the previously described apparatus through the tubing string to the nozzles mounted on the jet carrier body, so that the fluid pressure creates a twisting moment tending to angularly displace the spray nozzles about a central axis of the carrier body. The carrier body is then moved vertically along the internal sidewalls of the well casing while spraying cleaning fluid through the nozzles. Preferably, the spray nozzles on the outwardly extending arms are located approximately 1 inch from the perforations in the casing internal sidewalls during use. In one preferred method of performing the well cleaning operation, the well has a water bearing formation located at a known depth in the well bore. The previously described apparatus is used to move the jet nozzle carrier body with its cleaning nozzles slowly up and down by predetermined distances, for example, slowly up 10 feet and then back down to the well bottom, followed by moving the apparatus up 20 feet and then back to the well bottom, followed by moving the apparatus up 30 beet and then back to the well bottom, and repeating the procedure until a depth is reached about 10 feet above the depth of the water bearing formation. Alternatively, in some well cleaning operations, the cleaning apparatus is moved only inches at a time, leaving the apparatus at a given depth for 20-30 seconds at a flow rate of 25 gpm at 4000 psi.

An invention has been provided with several advantages. The cleaning apparatus of the invention is relatively simple in design and economical to manufacture. The location of the jet spray nozzles on the carrier body assures that the well casing perforations are effectively cleaned so that improved water flow is accomplished in the well. The associated apparatus used in the system of the invention is reliable and requires little in the way of maintenance. The following examples are given by way of illustration of the results achieved in using the method of the invention:

Wright Farm: Well abandoned for low productivity (reportedly less than 100 GPM). After treatment with the system of the invention, the well was measured with a flow meter and was producing at 550 GPM.

Sunrise Farms: Well pumping @ 110 GPM before treatment. After treatment, the well improved to 220 GPM (the full capacity of the pump). Measured by correlative pressure at the pump.

6R Farms: Well with historic plugging problems. The well pumped @ 300 GPM before treatment. After treatment, production improved to 700 GPM. Ratings according to the producer.

While the invention has been shown in only one of its forms, it is not thus limited but is susceptible to various changes and modifications without departing from the spirit thereof.

What is claimed is:

1. A system for cleaning water well casing of a water well having a well bore and a metal casing installed within the well bore, the casing having internal sidewalls of a given internal diameter and having at least a length thereof which is perforated to allow the flow of water from a surrounding subterranean formation, the system comprising:

a non-rotating tubing string formed from a synthetic polymeric material and having a surface end and a distal end;

a bearing assembly attached to the distal end of the tubing string and adapted to be lowered to a predetermined depth within the well bore, the bearing assembly having a generally tubular body with an internal flow path which provides a path for a cleaning fluid and having a central axis;

a jet carrier rotatably mounted on the bearing assembly along the bearing central axis for rotation about the central axis, the jet carrier having a carrier body with a pair of outwardly extending tubular arms which extend from the carrier body generally perpendicular to the central axis of the bearing assembly and of the carrier body, each arm terminating in a spray nozzle;

a source of pressurized cleaning fluid which communicates with the jet carrier for supplying fluid under pressure to the nozzles, each of said nozzles being adapted to expel the cleaning fluid against the casing internal sidewalls with an inertial force, the inertial force having an equal and opposite reactive force, at least one of the nozzles being mounted in the carrier body such that said reactive force is directionally offset from said carrier axis, thereby creating a twisting moment about the axis tending to rotate the carrier about the carrier central axis;

a take up reel located at the well surface for vertically moving the tubing string and carrier within the well bore;

wherein the length of the outwardly extending tubular arms on the carrier body is a predetermined distance, so that the spray nozzles located on the arms are positioned from within about ½ inch to 1½ inches from the perforations in the casing internal sidewalls in use; and wherein there are six fixed outlets on the carrier body, each having a ¼ inch type F NPT opening, and wherein a nipple is mounted in each outlet which is ¼ inch M NPT by ⅛ inch F NPT, so that the resulting assembled nozzles are ⅛ inch F NPT with an orifice size of 0.072 inch diameter and with a 25 degree spray.

2. The system of claim 1, wherein there are additional nozzles located on the carrier body which are not on outwardly extending tubular arms and which are also supplied with pressurized fluid for spraying the surrounding casing internal sidewalls.

3. The system of claim 1, wherein the source of pressurized cleaning fluid is a piston pump mounted on a flat bed truck and powered by a diesel engine, the pump being capable of producing at least about 25 gpm at 4000 psi.

4. A system for cleaning water well casing of a water well having a well bore and a metal casing installed within the well bore, the casing having internal sidewalls of a given internal diameter and having at least a length thereof which is perforated to allow the flow of water from a surrounding subterranean formation, the system comprising:

a non-rotating tubing string formed from a synthetic polymeric material and having a surface end and a distal end;

a bearing assembly attached to the distal end of the tubing string and adapted to be lowered to a predetermined depth within the well bore, the bearing assembly having a generally tubular body with an internal flow path which provides a path for a cleaning fluid and having a central axis;

a jet carrier rotatably mounted on the bearing assembly along the bearing central axis for rotation about the central axis, the jet carrier having a carrier body with a pair of outwardly extending tubular arms which extend from the carrier body generally perpendicular to the central axis of the bearing assembly and of the carrier body; each arm terminating in a spray nozzle;

a source of pressurized cleaning fluid which communicates with the jet carrier for supplying fluid under pressure to the nozzles, each of said nozzles being adapted to expel the cleaning fluid against the casing internal sidewalls with an inertial force, the inertial force having an equal and opposite reactive force, at least one of the nozzles being mounted in the carrier body such that said reactive force is directionally offset from said carrier axis, thereby creating a twisting moment about the axis tending to rotate the carrier about the carrier central axis;

a take up reel located at the well surface for vertically moving the tubing string and carrier within the well bore; and a roller cage mounted on the tubing string above the bearing assembly and jet carrier body for centralizing the bearing assembly and carrier body in the well bore during use, the roller cage having at least three longitudinal traveling arms alignable along the well bore axis, each of which has a roller mounted on either of two opposing outer extents thereof, each of the traveling arms being connected to the tubing string by a scissor mechanism which allows radial inward and outward movement of the tubing string as the rollers travel longitudinally along the well casing internal sidewalls.

5. The system of claim 4, wherein the length of the outwardly extending tubular arms on the carrier body is a predetermined distance, so that the spray nozzles located on the arms are positioned from within about ½ inch to 1½ inches from the perforations in the casing internal sidewalls in use.

6. The system of claim 5, wherein the spray nozzles are located approximately 1 inch from the perforations in the casing internal sidewalls.

7. The system of claim 4, wherein there are additional nozzles located on the carrier body which are not on outwardly extending tubular arms and which are also supplied with pressurized fluid for spraying the surrounding casing internal sidewalls.

8. The system of claim 4, wherein there are six fixed outlets on the carrier body, each having a ¼ inch type F NPT opening, and wherein a nipple is mounted in each outlet which is ¼ inch M NPT by ⅛ inch F NPT, so that the resulting assembled nozzles are ⅛ inch F NPT with an orifice size of 0.072 inch diameter and with a 25 degree spray.

9. The system of claim 4, wherein the source of pressurized cleaning fluid is a piston pump mounted on a flat bed truck and powered by a diesel engine, the pump being capable of producing at least about 25 gpm at 4000 psi.

10. A method of cleaning water well casing of a water well having a well bore and a metal casing installed within the well bore with a cleaning apparatus, the casing having internal sidewalls of a given internal diameter and having at least a length thereof which is perforated to allow the flow of water from a surrounding subterranean formation, the method comprising the steps of:

providing a non-rotating tubing string;

providing a source of fluid pressure for expelling a stream of fluid against the internal sidewalls of the well casing, the pressure source being arranged to communicate with the tubing string;

supplying fluid under pressure through the tubing string to a jet carrier body having a plurality of spray nozzles arranged thereon so that the fluid pressure creates a twisting moment tending to angularly displace the spray nozzles about a central axis of the carrier body;

moving the carrier body vertically along the internal sidewalls of the well casing while spraying cleaning fluid through the nozzles;

wherein at least selected nozzles are mounted on the jet carrier body by outwardly extending tubular arms which extend from the carrier body generally perpendicular to the central axis thereof, each arm terminating in a spray nozzle;

wherein the length of the outwardly extending tubular arms on the carrier body is a predetermined distance, so that the spray nozzles located on the arms are positioned from within about ½ inch to 1½ inches from the perforations in the casing internal sidewalls in use; and wherein the well has a water bearing formation located at a known depth in the well bore, and wherein the cleaning method used is to move the cleaning apparatus slowly up 10 feet and then back down to the well bottom, followed by moving the apparatus up 20 feet and then back to the well bottom, followed by moving the apparatus up 30 beet and then back to the well bottom, and repeating the procedure until a depth is reached about 10 feet above the depth of the water bearing formation.

* * * * *